US007207298B2

(12) United States Patent
Lee

(10) Patent No.: US 7,207,298 B2
(45) Date of Patent: Apr. 24, 2007

(54) COOLING SYSTEM FOR AN ENGINE

(75) Inventor: Bong Sang Lee, Suwon (KR)

(73) Assignee: Hyundai Motor Company, Seocho-Ku, Seoul (KR)

( * ) Notice: Subject to any disclaimer, the term of this patent is extended or adjusted under 35 U.S.C. 154(b) by 0 days.

(21) Appl. No.: 11/265,943

(22) Filed: Nov. 3, 2005

(65) Prior Publication Data

US 2006/0137626 A1 Jun. 29, 2006

(30) Foreign Application Priority Data

Dec. 23, 2004 (KR) ..... 10-2004-0110873

(51) Int. Cl.
*F01P 7/16* (2006.01)

(52) U.S. Cl. ..... 123/41.29; 123/41.1; 123/41.05

(58) Field of Classification Search ..... 123/41.29, 123/41.1, 41.7, 41.05
See application file for complete search history.

(56) References Cited

U.S. PATENT DOCUMENTS 6,152,088 A * 11/2000 Occella et al. ..... 123/41.1
6,568,356 B1 * 5/2003 Hayakawa et al. ..... 123/41.1
6,595,164 B2 * 7/2003 Kunze et al. ..... 123/41.1
6,758,171 B2 * 7/2004 Hwang ..... 123/41.05
6,874,450 B2 * 4/2005 Hwang et al. ..... 123/41.28
2003/0079699 A1 5/2003 Hwang

FOREIGN PATENT DOCUMENTS

DE 37 07 789 A1 9/1988
DE 199 38 614 A1 2/2001
JP 61 167115 7/1986

* cited by examiner

*Primary Examiner*—Stephen K. Cronin
*Assistant Examiner*—Ka Chun Leung
(74) *Attorney, Agent, or Firm*—Morgan Lewis & Bockius LLP

(57) ABSTRACT

A cooling system for an engine including a cylinder head, a cylinder block, coolant inlet lines, and coolant outlet lines. Coolant inlet lines for introducing coolant respectively to the cylinder head and the cylinder block are separately formed and coolant outlet lines for discharging coolant respectively from the cylinder head and the cylinder block are separately formed. Upstream ends of the cylinder-head-side and cylinder-block-side coolant inlet lines are respectively connected to a pre-chamber having a predetermined inner space.

2 Claims, 2 Drawing Sheets

COOLING SYSTEM FOR AN ENGINE

CROSS REFERENCE TO RELATED APPLICATION

This application claims priority to Korean Application No. 10-2004-0110873, filed on Dec. 23, 2004, the disclosure of which is incorporated herein by reference.

FIELD OF THE INVENTION

Generally, the present invention relates to a cooling system for an engine. More particularly, the present invention relates to a cooling system for an engine in which coolant passages for a cylinder block and a cylinder head are formed separately.

BACKGROUND OF THE INVENTION

In a conventional separated cooling system for an engine, as shown in FIG. 2, individual coolant inlet lines 10*a* and 11*a* introduce coolant into cylinder head 10 and cylinder block 11, and individual coolant outlet lines 10*b* and 11*b* discharge coolant from cylinder head 10 and cylinder block 11. Individual coolant inlet lines 10*a* and 11*a* and individual coolant outlet lines 10*b* and 11*b* are formed separately. U.S. Pat. No. 6,595,164 discloses one example of a separated cooling system for an engine.

In the conventional separated cooling system, coolant pump 12 for supplying coolant to cylinder head 10 and cylinder block 11, and radiator 14 for radiating the heat of coolant discharged from cylinder head 10 and cylinder block 11, are commonly used for cooling cylinder head 10 and cylinder block 11, but individual coolant inlet lines 10*a* and 11*a* and individual coolant outlet lines 10*b* and 11*b* are formed separately.

Cylinder-head-side coolant outlet line 10*b* connects cylinder head 10 and radiator 14 such that coolant discharged from cylinder head 10 flows directly into radiator 14, and a coolant line is formed such that coolant, having passed through radiator 14, flows to coolant pump 12. Main thermostat 13 is disposed in a coolant line connecting radiator 14 and coolant pump 12. Main thermostat 13 controls the flow of the coolant such that the coolant is supplied to cylinder head 10 and cylinder block 11 via coolant pump 12 only when the temperature of the coolant is within a predetermined temperature range. A portion of the coolant discharged from cylinder head 10 is supplied to heater 18 for heating a passenger room, and then is supplied to coolant pump 12 via main thermostat 13.

Meanwhile, block thermostat 15 for controlling flow of coolant discharged from cylinder block 11 is disposed in cylinder-block-side coolant outlet line 11*b*, and coolant, having passed through block thermostat 15, is supplied to coolant pump 12 via radiator 14. A portion of coolant discharged from cylinder-block-side coolant outlet line 11*b* is used for cooling oil cooler 16. A bypass line connecting block thermostat 15 and coolant pump 12 is formed. When the temperature of coolant discharged from coolant outlet line 11*b* is lower than a predetermined temperature, block thermostat 15 closes the coolant line so that coolant discharged from coolant outlet line 11*b* is directly supplied to coolant pump 12 via the bypass line.

In such a conventional cooling system, in which the coolant passages for cylinder head 10 and cylinder block 11 are separately provided, there is a disadvantage in that the pressures of the coolant supplied to cylinder head 10 and cylinder block 11 become non-uniform. Additionally, when block thermostat 15 is closed, the flow of the coolant in cylinder block 11 becomes congested. This causes the heat grade to deteriorate, and cylinder block 11 may become damaged by the heat.

SUMMARY OF THE INVENTION

The present invention provides a cooling system for an engine including a cylinder head and a cylinder block, separately formed coolant inlet lines for introducing coolant respectively to the cylinder head and the cylinder block, and separately formed coolant outlet lines for discharging coolant respectively from the cylinder head and the cylinder block. The upstream ends of the cylinder-head-side and cylinder-block-side coolant inlet lines are respectively connected to a pre-chamber having a predetermined inner space. The downstream ends of the cylinder-head-side coolant outlet line and the cylinder-block-side coolant outlet line may be respectively connected to a block thermostat for controlling flow of the coolant. The cooling system also includes a radiator, a radiator direction coolant line for guiding the coolant to flow to the radiator, a heater, a heater direction coolant line for guiding the coolant to flow to the heater, and a throttle body may be respectively connected to a housing of the block thermostat. Also, a coolant line may be connected to a housing of a main thermostat that is provided upstream of a coolant pump so as to allow the coolant to flow into the housing of the main thermostat.

In one embodiment, a cooling system for an engine includes: a cylinder head; a cylinder block; a coolant pump; a pre-chamber connected to the coolant pump to temporarily store coolant pumped by the coolant pump; a: first coolant line connected to the pre-chamber for guiding coolant to flow through the cylinder head; a second coolant line connected to the pre-chamber for guiding coolant to flow through the cylinder block; a first thermostat connected to the first and second coolant lines to receive the coolant discharged from the cylinder head and the cylinder block, the first thermostat being configured to control a flow of the coolant discharged from the cylinder block in response to the coolant temperature; a radiator connected to the first thermostat to receive at least a portion of the coolant discharged from the first thermostat, the radiator being configured to radiate the coolant's heat; and a second thermostat connected to the radiator and the coolant pump, the second thermostat being configured to control the coolant flow from the radiator to the coolant pump in response to the coolant temperature.

The cooling system may further include a heater direction coolant line connected to the first and second thermostats via either a heater or a throttle body. The heater direction coolant line allows at least a portion of the coolant discharged from the first thermostat to pass through either the heater or the throttle body.

The present invention thus provides a cooling system for an engine that achieves a uniform pressure grade of the coolant flowing to a cylinder head and a cylinder block of an engine, and improves the overall heat efficiency by using the heat of the coolant for heating a heater and preventing a throttle body from becoming frozen.

BRIEF DESCRIPTION OF THE DRAWINGS

The accompanying drawings illustrate exemplary embodiments of the present invention, and, together with the description, serve to explain the principles of the present invention, wherein.

DETAILED DESCRIPTION OF THE EMBODIMENTS

Figure 1:
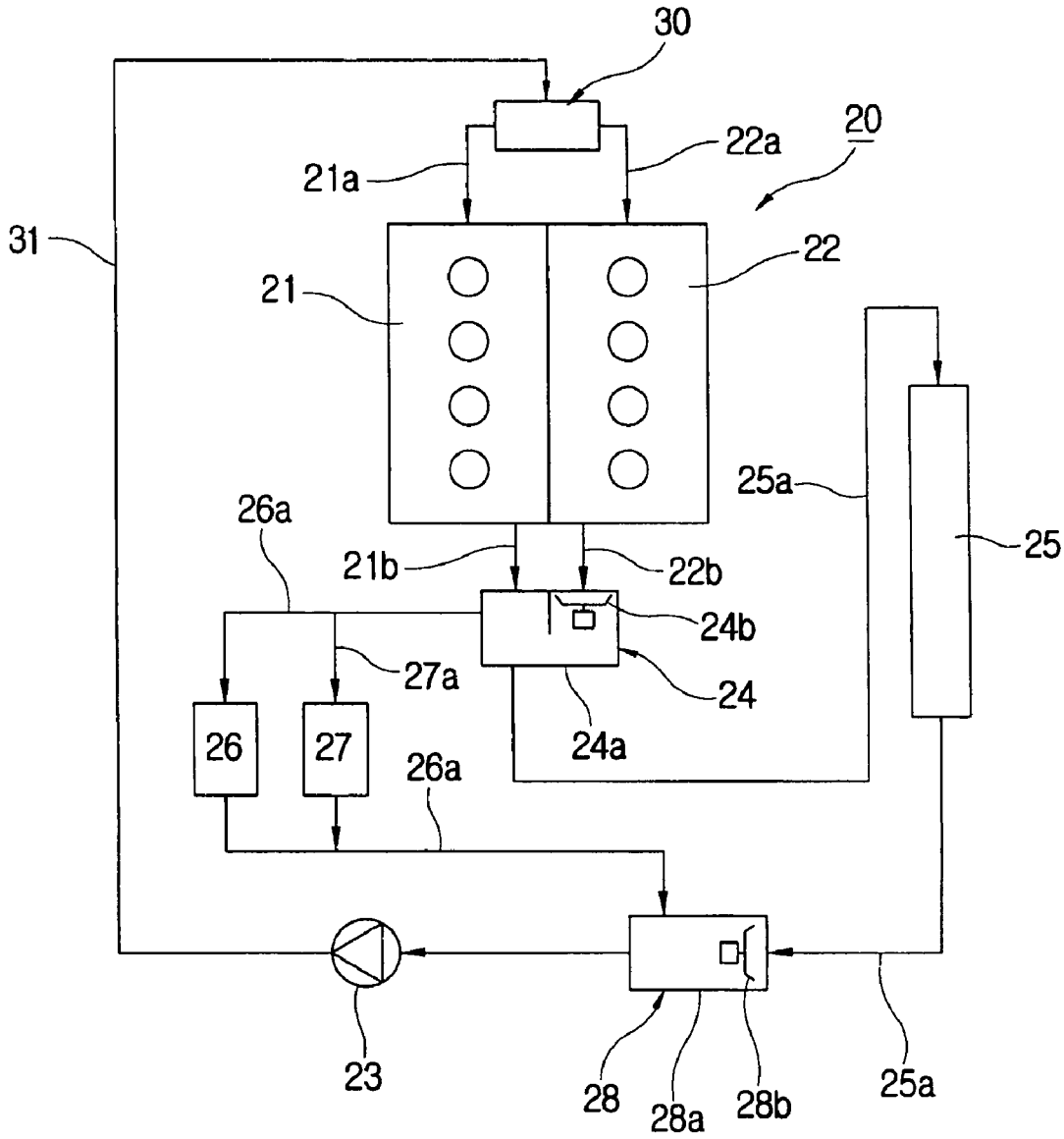
FIG. 1 is a schematic diagram of a cooling system for an engine according to an embodiment of the present invention.
Figure 2:
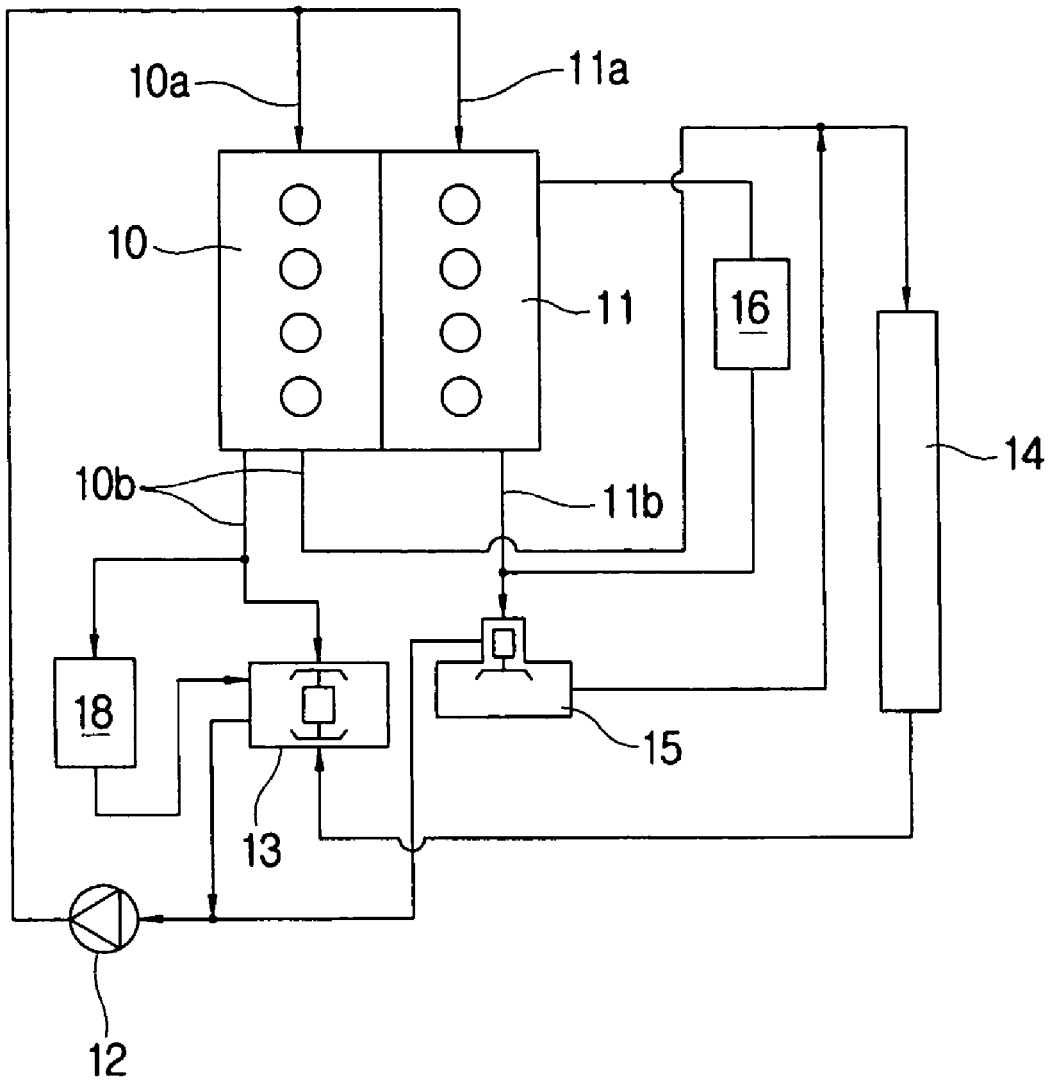
FIG. 2 (Prior Art)
FIG. 2 is a schematic diagram of a cooling system for an engine according to a prior art.

FIG. 1 is a schematic diagram of a cooling system for an engine according to an embodiment of the present invention, and a reference numeral 30 indicates a pre-chamber.

As shown in FIG. 1, the present invention is a cooling system cools engine 20 by circulating coolant through engine 20 and radiating heat from the coolant. The coolant may be cooling water. Coolant pump 23 pumps coolant to circulate through the cooling system. The cooling system includes a first coolant line and a second coolant line. The first coolant line is connected to pre-chamber 30 and guides coolant to flow through cylinder head 21 of the engine 20. The second coolant line is also connected to pre-chamber 30 and guides coolant to flow through cylinder block 22 of engine 20. As shown in FIG. 1, the first coolant line may include cylinder-head-side coolant inlet line 21 *a*, cylinder-head-side coolant outlet line 21 *b*, and coolant passageway (not shown) formed within cylinder head 21. Similarly, the second coolant line may include cylinder-block-side coolant inlet line 22*a*, cylinder-block-side coolant outlet-line 22*b*, and coolant passageway (not shown) formed within the cylinder block 22.

Cylinder-head-side coolant inlet line 21*a* for introducing coolant into cylinder head 21 and cylinder-block-side coolant inlet line 22*a* for introducing coolant into cylinder block 22 are formed separately, and cylinder-head-side coolant outlet line 21*b* for discharging coolant from the cylinder head 21 and cylinder-block-side coolant outlet line 22*b* for discharging coolant from cylinder block 22 are also formed separately, as is in the conventional art.

Pre-chamber 30 equalizes pressure of the coolant that will be supplied to cylinder head 21 and cylinder block 22. Coolant line 31 connects coolant pump 23 to pre-chamber 30 and supplies coolant pumped from coolant pump 23 to pre-chamber 30. Cylinder-head-side coolant inlet line 21*a* connects pre-chamber 30 to cylinder head 21 and supplies coolant to cylinder head 21. Cylinder-block-side coolant inlet line 22*a* connects pre-chamber 30 to cylinder block 22 and supplies coolant to cylinder block 22. Therefore, coolant pumped by coolant pump 23 is supplied to pre-chamber 30 and is temporarily stored therein, and coolant temporarily stored in pre-chamber 30 is then supplied to cylinder head 21 and cylinder block 22 respectively through coolant inlet lines 21*a* and 22*a*.

Pre-chamber 30 has a predetermined inner space. For example, pre-chamber 30 may define a space having a cross-sectional area greater than that of coolant line 31 connecting coolant pump 23 and pre-chamber 30. The coolant pumped by coolant pump 23 is temporarily stored in pre-chamber 30, thereby being uniformly mixed, so that the pressure of the coolant is equalized and is then supplied to cylinder head 21 and cylinder block 22 respectively through coolant inlet lines 21*a* and 22*a*. Accordingly, pressure of the coolant supplied to cylinder head 21 and cylinder block 22 becomes substantially uniform due the existence of pre-chamber 30.

Downstream ends of cylinder-head-side coolant outlet line 21*b* and cylinder-block-side coolant outlet line 22*b* are respectively connected to housing 24*a* of block thermostat (i.e., first thermostat) 24 that controls the flow of coolant discharged from cylinder head 21 and cylinder block 22 respectively through coolant outlet lines 21*b* and 22*b*. That is, block thermostat 24 is connected to the first and second coolant lines to receive coolant discharged from cylinder head 21 and cylinder block 22, and it is configured to control flow of coolant discharged from cylinder block 22 in response the coolant temperature discharged from cylinder block 22.

Valve device 24*b*for controlling flow of coolant through cylinder-block-side coolant outlet line 22*b*is provided within housing 24*a*of block thermostat 24, but no valve device is provided for cylinder-head-side coolant outlet line 2l*b*.

Radiator direction coolant line 25*a* allows coolant to flow toward a radiator 25 and heater direction coolant line 26*a* allows coolant to flow toward heater 26, and are respectively connected to housing 24*a* of block thermostat 24. As shown in FIG. 1, heater direction coolant line 26*a* is connected to block thermostat 24 and main thermostat (i.e. second thermostat) 28 via at least one of either heater 26 or throttle body 27. Heater direction coolant line 26*a* is configured to allow at least a portion of coolant discharged from block thermostat 24 to pass through at least one of either heater 26 or throttle body 27. In particular, throttle body direction cooling line 27*a* allows coolant to flow through throttle body 27 to prevent throttle body 27 from being frozen is branched from heater direction coolant line 26*a*. Radiator 25 is, as shown in FIG. 1, connected to block thermostat 24 to receive at least a portion of the coolant discharged from block thermostat 24, and it is configured to radiate the coolant's heat.

The coolant lines are configured such that coolant that has passed through radiator 25 through radiator direction coolant line 25*a*, and coolant that has passed through heater 26 and throttle body 27 through heater direction coolant line 26*a*, are joined together to the main thermostat 28, which is disposed upstream of coolant pump 23. Coolant pump 23 controls the flow of coolant from main thermostat 28. Valve device 28*b* is provided within housing 28*a* of main thermostat 28 to control flow of coolant from radiator 25 to main thermostat 28, but no valve device is provided for heater direction coolant line 26*a*. Therefore, main thermostat 28 is connected to radiator 25 and coolant pump 23, and it is configured to control the flow of coolant from radiator 25 to coolant pump 23 in response to the temperature of coolant discharged from radiator 25.

Because upstream ends of coolant inlet lines 21*a* and 22*a*, which are respectively connected to cylinder head 21 and cylinder block 22 for separately cooling engine 20, are connected to pre-chamber 30, coolant (that may be in a state of non-uniform pressure) pumped by coolant pump 23 is mixed in an inner space of pre-chamber 30 before being branched into cylinder-head-side coolant inlet line 21*a* and cylinder-block-side coolant inlet line 22*a*. Mixing of the coolant in pre-chamber 30 equalizes the pressure of the coolant so that the pressures of the coolant supplied to cylinder head 21 and cylinder block 22 via coolant inlet lines 21*a* and 22*a* are substantially uniform.

Additionally, because pre-chamber 30 is provided in the cooling system, a minute coolant flow exists due to a pressure difference between cylinder-block-side coolant inlet and outlet lines 22*a*and 22*b*, even when block thermostat 24 connected to cylinder-block-side coolant outlet line 22*b*is closed. This causes the heat gradient in cylinder block 22 to be stable, so that a deformation of cylinder bores and abnormal friction can be minimized. When block thermostat 24 is closed, coolant still flows through cylinder-head-side coolant inlet and outlet lines 21*a*and 21*b*, so that a pressure gradient within pre-chamber 30 is formed. Because coolant has a viscosity, such pressure gradient within pre-chamber 30 causes a minute reverse flow of coolant from cylinder block 22 to pre-chamber 30. This minute reverse flow of coolant from cylinder block 22 to pre-chamber 30 may cool down cylinder block 22 even when block thermostat 24 is closed.

Furthermore, some coolant discharged from coolant outlet lines 21*b* and 22*b* flows to radiator 25. Also, some coolant flows to at least one of either heater 26 or throttle body 27, so that the coolant heat can be provided to heater 26 or can prevent throttle body 27 from becoming frozen.

While this invention has been described in connection with what is presently considered to be the most practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A cooling system for an engine including a cylinder head and a cylinder block, comprising:

a coolant pump;

a pre-chamber connected to the coolant pump to temporarily store coolant pumped by the coolant pump;

a first coolant line connected to the pre-chamber for guiding coolant to flow through the cylinder head;

a second coolant line connected to the pre-chamber for guiding coolant to flow through the cylinder block;

a first thermostat connected to the first and second coolant lines to receive the coolant discharged from the cylinder head and the cylinder block, the first thermostat being configured to control a flow of the coolant discharged from the cylinder block in response to a temperature of the coolant;

a radiator connected to the first thermostat to receive at least a portion of the coolant discharged from the first thermostat, the radiator being configured to radiate heat of the coolant; and a second thermostat connected to the radiator and the coolant pump, the second thermostat being configured to control a flow of the coolant from the radiator to the coolant pump in response to a temperature of the coolant.

2. The cooling system of claim 1, further comprising: a heater direction coolant line connected to the first and second thermostats via at least one of a heater and a throttle body, the heater direction coolant line allowing at least a portion of the coolant discharged from the first thermostat to pass through at least one of the heater and the throttle body.

* * * * *